United States Patent [19]

Fried et al.

[11] Patent Number: 4,723,525

[45] Date of Patent: Feb. 9, 1988

[54] INTERNAL COMBUSTION ENGINE WITH A PRESSURE WAVE SUPERCHARGER

[75] Inventors: Reinhard Fried, Nussbaumen; François Jaussi, Döttingen; Fritz Spinnler, Arisdorf, all of Switzerland

[73] Assignee: BBC Brown, Boveri & Company, Limited, Baden, Switzerland

[21] Appl. No.: 872,896

[22] Filed: Jun. 11, 1986

[30] Foreign Application Priority Data

Jun. 26, 1985 [CH] Switzerland ..... 2714/85

[51] Int. Cl.[4] ..... F02B 33/42

[52] U.S. Cl. ..... 123/559

[58] Field of Search ..... 123/559; 417/64; 60/39.45

[56] References Cited

U.S. PATENT DOCUMENTS 2,853,987 9/1958 Berchtold et al. ..... 123/559

3,180,330 4/1965 Barnes ..... 123/559

4,414,952 11/1983 Fried et al. ..... 123/559

FOREIGN PATENT DOCUMENTS 378595 7/1964 Switzerland ..... 123/559

*Primary Examiner*—Michael Koczo

*Attorney, Agent, or Firm*—Burns, Doane, Swecker & Mathis

[57] ABSTRACT

The pressure wave supercharger of the internal combustion engine has a diaphragm capsule (20) for controlling the supercharge air butterfly (14). The diaphragm (21) of the diaphragm capsule is, in operation, subjected on the butterfly side to the high pressure air in the high pressure air duct (2) and on the other side to the pressure at the protrusion 27 or in the compression pocket (5), via a control pressure line (26; 28). These pressures typical of the process vary with the speed of the cell rotor and control the setting of the supercharge air flap as a function of the speed and loading condition of the engine.

7 Claims, 10 Drawing Figures

INTERNAL COMBUSTION ENGINE WITH A PRESSURE WAVE SUPERCHARGER

FIELD OF THE INVENTION

The present invention concerns combustion engines and is particularly related to an internal combustion engine with a pressure wave supercharger.

BACKGROUND OF THE INVENTION

In an internal combustion engine with a pressure wave supercharger as the supercharging device, a starting valve or a starting butterfly valve acts to shut off the supercharge air line between the pressure wave supercharger and the inlet side of the engine during engine starting because the pressure wave process is still not running correctly after the engine fires, with the particular effect that the supercharge air still contains too much exhaust gas and the engine would be smothered by a supercharge of such an air/exhaust gas mixture. In this phase, therefore, the engine must be operated with air induced directly from the environment and, for this purpose, a weakly spring-loaded valve opened by the engine suction (a so-called snifter valve) is provided in the supercharge air line between the supercharge air butterfly valve and the induction manifold of the engine. As soon as the exhaust gas pressure before the cell rotor of the pressure wave supercharger is high enough to maintain a functioning pressure wave process, the supercharge air butterfly valve is opened and the engine is supplied, during further operation, with supercharge air generated by the pressure wave supercharger. The pivoting of the butterfly valve for the purpose of opening the charge air duct can be effected by a cylinder with a piston or diaphragm; the cylinder is subjected to the pressure difference between the exhaust gas pressure and the supercharge air pressure or between the latter and the ambient air pressure and has an active connection with the supercharge air butterfly valve.

In another known pistonless concept, the supercharge air butterfly valve is supported asymmetrically relative to the central axis of the supercharge air duct. As soon as the pressure wave process has come into operation after the engine is started, this butterfly valve is pulled away from its closed, locked position by the dynamic pressure of the supercharge air or by the pressure difference before and after the butterfly valve and then remains freely pivotable in the supercharge air flow during the duration of operation, its angular position adjusting itself in accordance with the dynamic pressure of the supercharge air flow. When the engine is shut down, the butterfly valve returns to its closed and locked initial position.

The above-mentioned concepts of supercharge air butterfly valves have been developed for pressure wave superchargers which have a constant gear ratio positive drive from the internal combustion engine, preferably by means of a belt drive. If the intention is that the full idling range of the engine should be satisfactorily covered with the butterfly valve fully opened, they have the disadvantage of requiring a particular geometrical design of the control edges formed by the air and gas ducts and of the pockets and other ducts and recesses in the gas and air casings. This design is not, however, the best possible one, particularly in the upper load range. Since the advantage of a pressure wave supercharger relative to an exhaust gas turbocharger consists precisely in a more rapid response of the engine to a demand for increased power in this operating range, this design represents a compromise at the expense of this range, which is the most important one for practical driving. A pressure wave supercharger designed for this range does, however, offer reserves within it and this makes it possible—for an engine of a given power—either to use a smaller pressure wave supercharger or to obtain better utilisation of the power potential of an engine using a pressure wave supercharger of a given size.

In the known concepts mentioned above, the supercharge air butterfly valve is either closed for too long a period after the engine starts, so that the engine power cannot be achieved in an optimum fashion, or it is continuously open to a greater or lesser extent during the running of the engine and is only completely closed during the starting phase; such a concept is not, therefore, feasible for a free running pressure wave supercharger. This is because, when the pressure wave supercharger is free running and driven by the exhaust gas flow alone, the speed of the pressure wave supercharger is still very low immediately after the engine fires, and it follows that with the supercharge air butterfly valve open, the recirculated exhaust gas quantity is very high so that the engine would immediately be smothered.

The concepts mentioned above also mean that emergency operation in the case of a damaged rotor of the pressure wave supercharger is only possible to a limited extent because, when the rotor is at rest, the closed supercharge air butterfly valve can be pulled away from its catch and pressed upwards by the large dynamic pressure of the exhaust gas before the butterfly valve; the exhaust gases can then enter the induction manifold of the engine. The reason for this is that, in contrast to exhaust gas turbochargers (in which the compressor and the turbine are separate) a short circuit between the high pressure gas duct and the high pressure air duct can occur in the case of pressure wave superchargers when the rotor is at rest; this leads to a direct passage of exhaust gas into the induction manifold of the engine and would lead to the engine being smothered.

OBJECTS AND SUMMARY OF THE INVENTION

The objective of the present invention, consists—for the purpose of achieving an optimum pressure wave process and the best possible engine power in each case—in keeping the supercharge air line closed whenever and as long as operating conditions are present in which the recirculated exhaust gas quantities in the supercharge air are too high.

These operating conditions include:

- the cold and warm starting of the engine,
- the warming-up phase after the cold starting of the engine,
- the complete idling speed range, particularly the upper breakaway speed range,
- the lower part-load range between 10 and 25% of the maximum mean effective pressure ($p_{memax}$),
- the condition with the rotor at rest as the limiting case, i.e. the emergency operation case, for example due to rotor damage or a torn belt.

The degree of exhaust gas recirculation under these operating conditions depends on the type of drive or on the speed of the pressure wave supercharger.

At the moment, the only types of drive considered in practice are positive drive, preferably by belt drive, and drive of the free-running rotor by the exhaust gas flow.

With the supercharge air line closed, the engine, as mentioned at the beginning, induces the combustion air from the environment through the breather valve located after the supercharge air butterfly valve, an air filter being fitted upstream of the breather valve.

Operational safety requires that the supercharge air butterfly valve be closed when the rotor is jammed; this applies particularly in the case of mineral ceramic rotors because debris from the bursting of such rotors would damage the engine. This also ensures emergency operation, which has to make the journey home possible under the vehicle's own power, in induction engine operation, in the case of such a failure or of another type of failure.

In the case of free-running pressure wave superchargers driven by the exhaust gas flow alone, such a supercharge air butterfly valve must remain closed in the starting phase until the built up exhaust gas flow has, during engine run-up, accelerated the rotor from rest to a high speed sufficient for the functioning of the pressure wave process without or with only slight exhaust gas recirculation.

The fundamental objectives of the known concepts mentioned above must therefore be extended by a very important condition. This condition consists in the fact that the actuating device of the butterfly valve must only open when a pressure difference, which depends on the pressure wave process, has achieved a value sufficiently large for the functioning of the pressure wave process. Since, when the rotor is at rest, no pressure wave process occurs, this makes emergency operation possible without any further measures.

A further objective of the invention is a simple and cheaply manufactured design of the supercharge air butterfly and the elements interacting with it for its actuation and control. A contribution is made by the fact that process typical parameters, i.e. parameters related to the pressure wave process, are used for the actuation in order to avoid the mechanical complexity which would be associated with using parameters for this purpose, which are, for example, typical of the engine. A further requirement is that there should be no consequential damage to the engine in the case of a failure. In a special embodiment, a valve controlled as a function of temperature is used to avoid the supercharge air temperature becoming too high and overheating the engine. The cause of an excessive supercharge air temperature can be blockage of the air filter or the exhaust which, among other things, causes excessive recirculation of exhaust gas into the supercharge air line.

BRIEF DESCRIPTION OF THE DRAWING

The invention is described in more detail below with reference to the embodiment examples shown in the drawings.

In the drawings.

DETAILED DESCRIPTION OF THE PREFERRED EMBODIMENT

Figure 1:
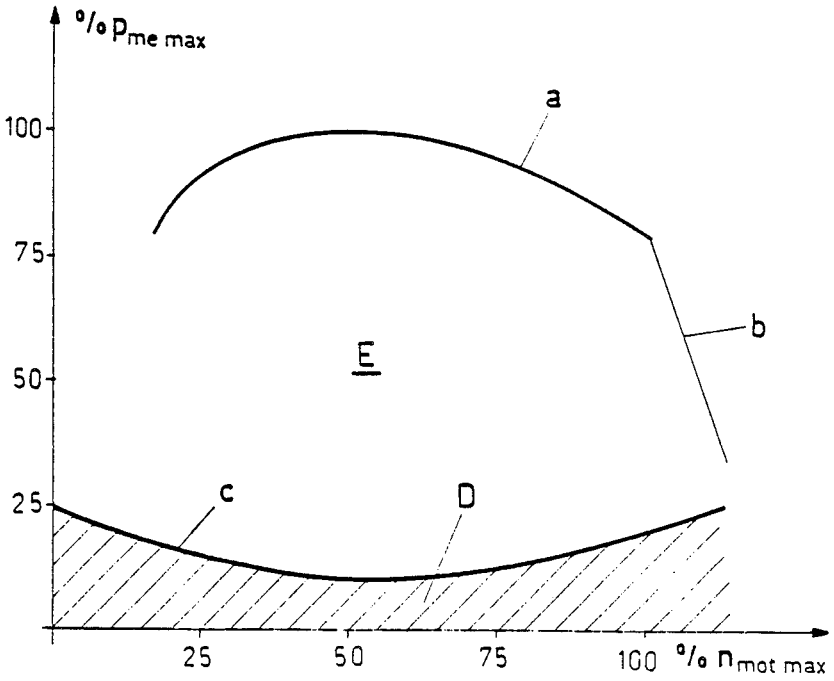
FIG. 1 presents a diagram which shows the relationship between the operating condition and the position of the supercharge air butterfly valve.

The diagram of FIG. 1 shows how, in the case of a typical passenger car engine, the supercharge air butterfly valve must be controlled as a function of the load and the engine speed in order to satisfy the conditions, mentioned in the introduction, for obtaining an optimum pressure wave process and the best possible engine power.

The curve "a" gives the relationship between the mean effective pressure $p_{me}$ in the motor cylinders and the engine speed $n_{mot}$ at full load. After reaching the nominal maximum speed of 100% $n_{motmax}$ the curve "a" joins the straight line "b", which corresponds to the variation of $p_{me}$ during speed regulation, i.e. the throttling of the fuel supply for the purpose of protecting the engine after 100% $n_{motmax}$ is exceeded. The curve "c" forms the upper limit of a zone D in which the supercharge air butterfly valve must be closed whereas, in the zone E between the curves "c" and "a", it is open to a greater or lesser extent. The diagram therefore shows that the supercharge air butterfly valve keeps the supercharge air line closed not only in the starting and warming-up phases but also in the ranges mentioned of lower and higher idling speeds and lower part-load. In these ranges, the engine, as mentioned, induces the air from the atmosphere behind the supercharge air butterfly valve via a breather valve.

The elements which are important for the control of the supercharge air butterfly valve are explained below using FIG. 2, which reproduces a developed cylindrical section at half the height of the cell rows of a pressure wave supercharger with two cycles.

In this connection, "cycle" is understood to mean the totality of the main and auxiliary ducts necessary for carrying out the pressure wave process. The first group includes a low pressure air duct 1, through which the air from the atmosphere is induced into cells 10 of a cell rotor 9, these cells being bounded by cell walls 11, a high pressure air duct 2, which leads the supercharge air, which is compressed in the cells 10 by the high pressure gas flowing from the engine, to the engine (and which, for brevity, is referred to below as the supercharge air duct 2), also a high pressure gas duct 3, through which the high pressure gas expelled from the engine cylinders reaches the cells 10 in order to compress the air located in them, and a low pressure gas duct 4, through which the exhaust gas expanded in the cells 10 flows to the open air.

The auxiliary ducts include a compression pocket 5, an expansion pocket 6 and a gas pocket 7, which serve to maintain, in known manner, a functioning pressure wave process over the complete operating range of the engine, i.e. also outside the practically important operating range for which the ducts 1 to 4 are designed, and an upstream pocket 8, whose purpose is associated with the present invention.

The main ducts 1 and 2 and the auxiliary ducts 5 and 6 are located in an air casing 12, the main ducts 3 and 4 and the auxiliary ducts 7 and 8 being located in a gas casing 13. These two casings enclose a rotor casing (not shown), which accepts the rotor 9, at the sides and the air casing 12 also accepts the bearimg elements (not shown) for the overhung rotor 9, whose direction of rotation is indicated by the black arrow.

When the supercharge air butterfly valve 14 is closed, the engine induces the combustion air directly from the environment into the supercharge air duct 2 via an auxiliary induction line 15 and a weakly spring-loaded snifter valve 16 located at the entry point of the auxiliary induction line.

The supercharge air butterfly valve 14 is supported symmetrically with reference to its shaft 17 and upstream of the breather valve in the supercharge air duct 2, viewed in the flow direction of the supercharge air. As stated at the beginning, its task consists, inter alia, of shutting off the supercharge air duct 2 during the starting and warming-up phase until the exhaust gas pressure in the rotor cells 10 is high enough to build up a functioning pressure wave process. For this purpose, the supercharge air butterfly valve 14 is connected to a diaphragm 21 of a diaphragm capsule 20 by means of a rod 19 pin-jointed to the butterfly valve 14 by a pin 18. A spring 22 in the diaphragm capsule 20 loads the diaphragm 21 in the closing direction of the butterfly valve 14.

The butterfly valve-side space 23 of the diaphragm capsule 20 is conductively connected to the supercharge air duct 2 via a hole 24 in the wall of the latter and is therefore subject to the pressure before the butterfly valve 14. The spring-side space 25 of the diaphragm capsule is connected to the rotor space of the pressure wave supercharger via a control pressure line 26, the connection being to the region of a protrusion 27 in the air casing 12. This protrusion is part of the rotor-side boundary of the air casing and extends between the low pressure air duct 1 and the compression pocket 5.

The mode of operation of this variant of the control device for the supercharge air butterfly valve is based on the pressure difference acting on the diaphragm 21 when the supercharger is running. After the starting procedure, the engine initially operates as an induction motor with the supercharge air butterfly valve 14 held closed by the spring 22, taking the combustion air necessary from the ambient air via the breather valve 16. After the starting procedure, the supercharge air butterfly valve remains closed as long as the pressure in the spring-side space 25 of the diaphragm capsule 20 is the same as that in the flap-side space 23 and this continues as long as the pressure wave process is not yet fully developed because of too low a speed of the rotor 9 and/or an engine load which is too low. Under this condition, the high pressure gas passes (as indicated by the thin flow arrows) from the duct 3, on the one hand via two of the cells 10 into the supercharge air duct 2 and on the other hand as a result of leakage via the upstream pocket 9, three of the cells 10 and a compression pocket 5 into the control pressure line 26, so that the same pressure exists on both sides of the diaphragm 21. The supercharge air butterfly valve 14 is then held in the closed position by the spring 22.

However, as soon as the rotor 9 achieves higher speeds and load is applied to the engine, the pressure wave process comes into operation so that air is already being compressed and the pressure in the supercharge air duct 2 increases. In the protrusion 27, on the other hand, the pressure decreases, as shown by the curve d of FIG. 8, so that the supercharge pressure displaces the diaphragm 21 against the force of the spring 22 and of the pressure in the spring-side space 23 and opens the supercharge air butterfly valve 14 to a greater or lesser extent via the rod 19. As soon as the supercharge air flow is sufficient for operating the engine, the breather valve 16 is closed by the supercharge air pressure.

In the embodiment described, the presence of an upstream pocket 8 is a condition for the possibility of emergency operation. This is because in the case of a jammed rotor, the pressure in the supercharge air line before the supercharge air butterfly valve 14 is equal to the pressure in the region of the protrusion before the supercharge air duct 2, as is apparent from what has been stated already, so that the spring 22 keeps the butterfly valve 14 closed and, for example, debris from a damaged rotor cannot pass into the engine.

Figure 2:
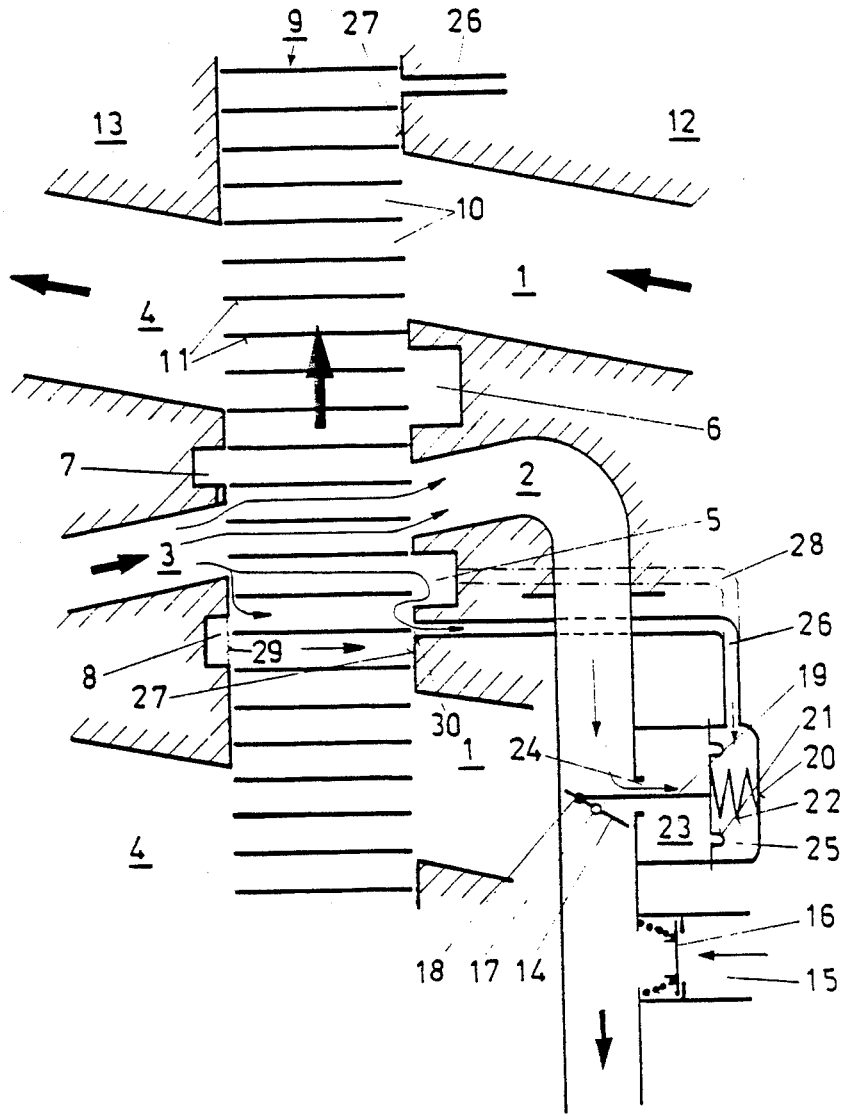
FIG. 2 presents a diagram of a pressure wave supercharger according to the invention with a first embodiment form of the control device.

A variant of the previously described embodiment form is emphasised by dash-dot lines in FIG. 2. In this variant, the control pressure line 28 branches off from the compression pocket 5 and the upstream pocket 8 becomes unnecessary, as indicated by the dash-dot line 29 which, in this variant, forms the boundary of the gas casing instead of the upstream pocket. For the operating conditions with the supercharge air butterfly valve 14 closed and during emergency operation, the exhaust gas passes from the high pressure exhaust gas duct 3 via the cells 10 and without the deviation via an upstream pocket directly into the compression pocket 5 and on into the control pressure line 28, while the path of the exhaust gas into the supercharge air line 2 is the same as that in the variant with upstream pocket. For both variants, the width of the cells has to be smaller than the width of the entry cross-sections of the ducts 2 and 3, the compression pocket 5 and the upstream pocket 8, measured in the peripheral direction in each case. This ensures that when a cell is passing in front of the entry of these ducts into the rotor space, there are always free flow paths of a sufficiently large cross-section between the appropriate main and auxiliary ducts 2, 3, 5 and 8 of the gas and air casings.

Figure 3:
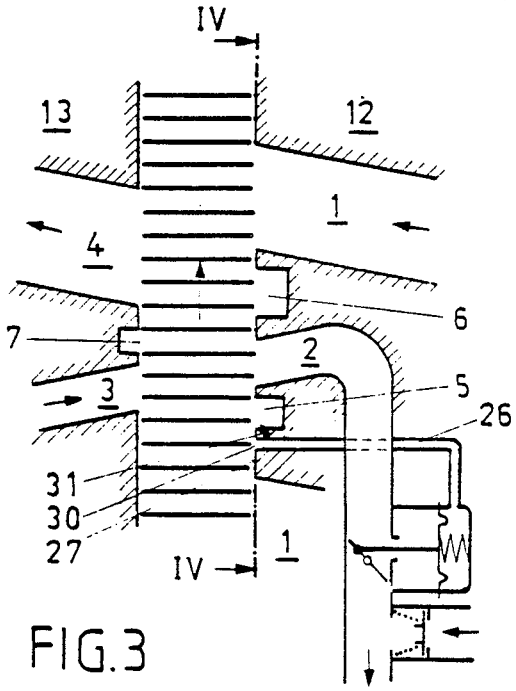
FIG. 3 presents a diagram of a pressure wave supercharger with a variant of the control device of FIG. 2.
Figure 4:
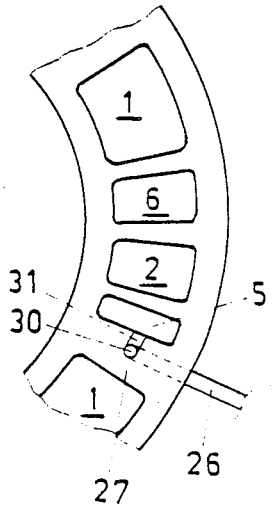
FIG. 4 shows a detail of a side view of the supercharge casing at the section IV—IV shown in FIG. 3.

The way in which the flow of high pressure exhaust gas from the duct 3 into the control pressure line 26 can be ensured in the absence of an exhaust gas side upstream pocket 8, may be seen from FIGS. 3 and 4. The concept of the main and auxiliary ducts corresponds to that of FIG. 2 with the connection of the control pressure line 26 at the protrusion 27 between the compression pocket 5 and the low pressure air duct 1 of the previous cycle. As may be seen from the view onto the ducts of the air casing 12 in accordance with the section line IV—IV drawn in FIG. 3, the entry 30 of the control pressure duct 26 is conductively connected to the compression pocket 5 by a narrow transfer duct 31. This also meets the requirement for emergency operation.

Figure 6:
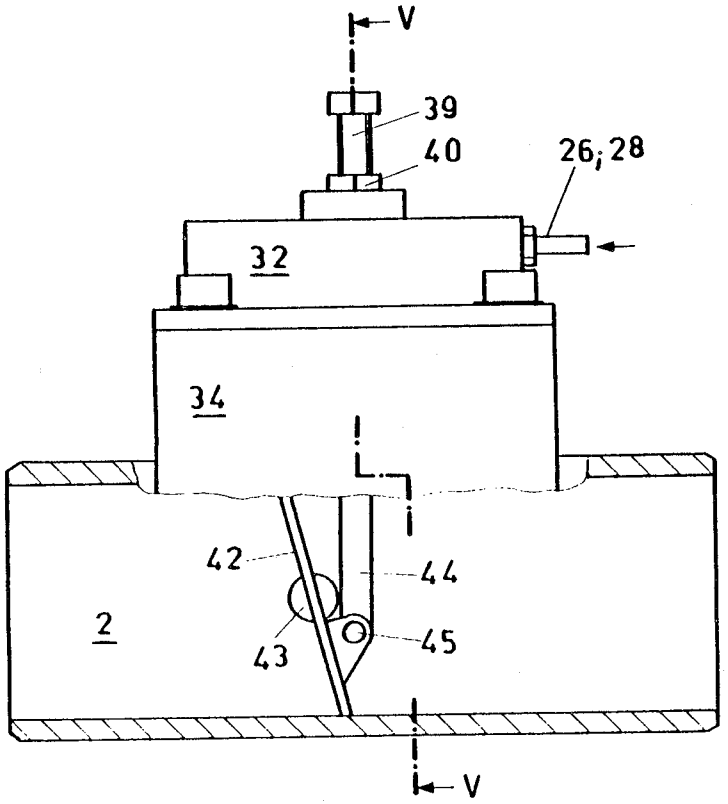
FIG. 6 shows a partially sectioned side view of a setting device for the supercharge air butterfly valve.
Figure 5:
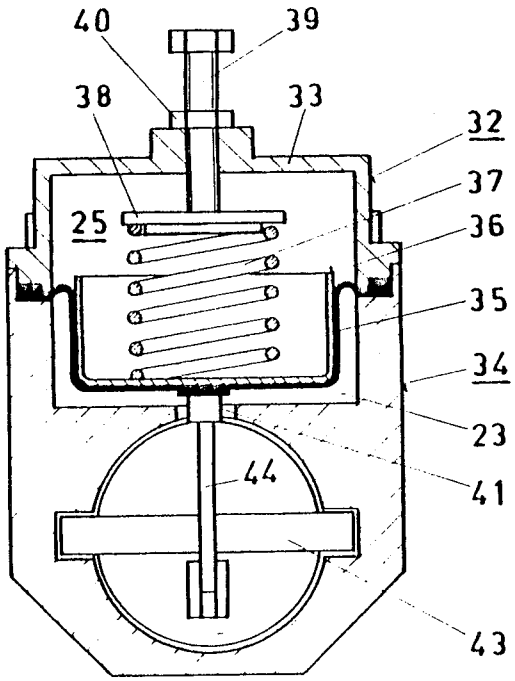
FIG. 5 shows a cross-section of a setting device for the supercharge air butterfly valve taken along section V—V shown in FIG. 6.

A practical diaphragm capsule and a supercharge air butterfly valve, together forming a structural unit, are shown in FIGS. 5 and 6. The cross-section of FIG. 5, corresponding to the section line V—V drawn in FIG. 6, shows that the diaphragm capsule 32 is of known type. The rim of a diaphragm 35 supported by a spring plate 36 is clamped between the diaphragm casing 33 and the butterfly casing 34. The spring 37 is supported at the top against a compression spring plate 38. A setting screw 39 with a lock nut 40 permits the matching of the spring prestress to the pressure relationships of a given pressure wave supercharger. The spring-side space 25 of the diaphragm capsule is connected via one of the above-mentioned control pressure lines 26 or 28 to the protrusion 27 (explained by means of FIG. 2) or to the compression pocket 5, while the butterfly valve-side space 23 communicates via a hole 41 with the supercharge air duct 2. The supercharge air butterfly valve 42 is centrally supported, in the supercharge air duct 2, about a shaft 43 in the butterfly casing 34. The rod 44 is pin-jointed to the butterfly 42 by means of a pin 45 and is vulcanized onto the diaphragm 35. The elasticity of the diaphragm 35 permits the lateral deflections of the rod 44 which occur when the butterfly valve 42 pivots.

Figure 7:
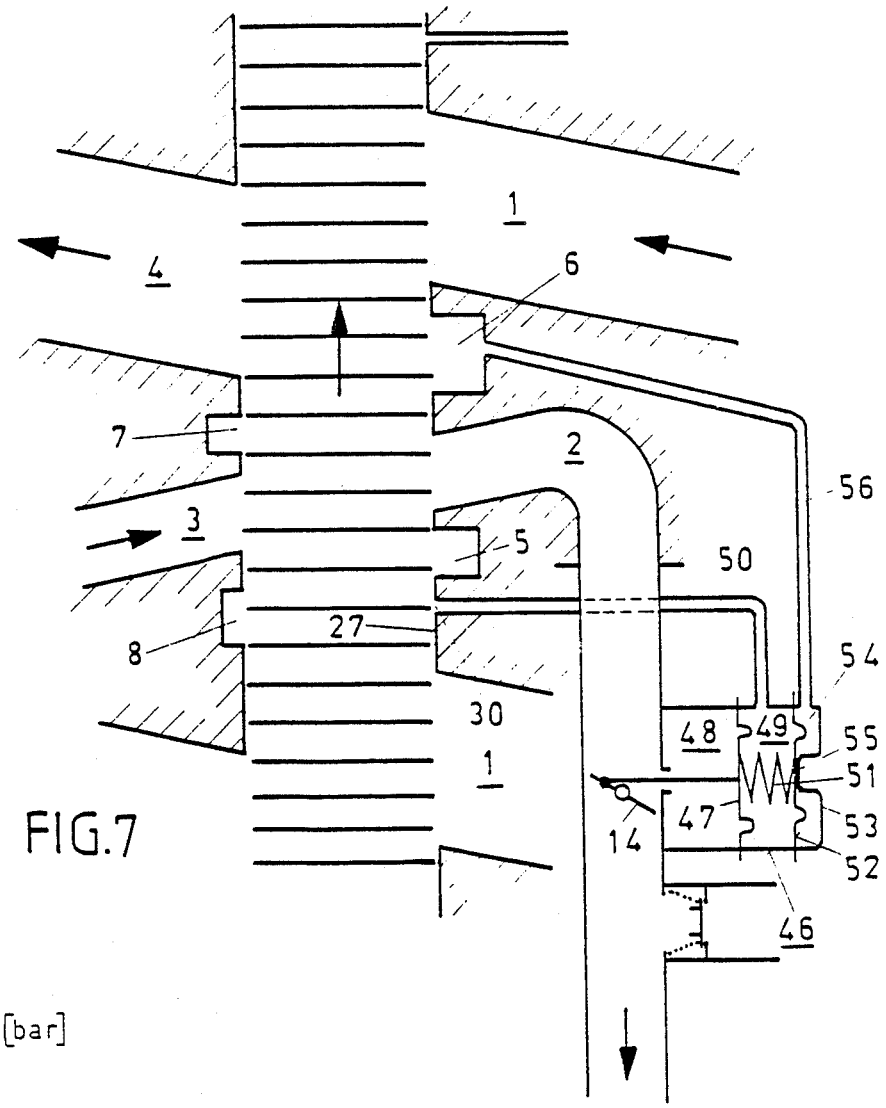
FIG. 7 presents a diagram of a pressure wave supercharger with a further embodiment form of the control device.

The concept shown diagrammatically in FIG. 7 provides improved behaviour in the upper idling range compared with the previously described arrangements. In this range, this control system keeps the supercharge air butterfly valve closed, by means of a second diaphragm in the diaphragm capsule, up to even higher speeds than in the case of the diaphragm capsule with only one diaphragm. By means of this second diaphragm, it is possible to use a further pressure typical of the process to control the butterfly 14. Particularly suitable for this purpose is the pressure in the expansion pocket 6, by means of which the supercharge air butterfly valve 14 can be kept closed in the upper idling range up to 25% of the maximum mean effective pressure in the engine cylinders.

The double diaphragm capsule 46 has three spaces subjected to pressures typical of the process. A primary diaphragm 47 separates a butterfly valve-side space 48, in which the supercharge air pressure is present during operation, from a spring-side space 49, which can be connected via a primary control pressure line 50 (as in the case of the simple diaphragm capsule of FIG. 2) either to the protrusion 27 between the compression pocket 5 and the low pressure air duct 1 of the previous cycle or, in a similar manner to the arrangement of FIG. 2, via the line shown chain-dotted in that figure to the compression pocket 5. A spring 51 is clamped between the primary diaphragm 47 and a secondary diaphragm 52. The latter, together with the cap 53 of the double diaphragm capsule 46, bounds a cap-side space 54 with a stop 55, formed by a cylindrical depression, for the secondary diaphragm 52 and the spring 51. The cap-side space 54 is connected to the expansion pocket 6 by means of a secondary control pressure line 56.

In the lower speed range, the mode of operation of the double diaphragm capsule 46 is the same as that of the simple diaphragm capsule because, in this case, the pressure in the protrusion 27 between the compression pocket 5 and the low pressure air duct 1 of the previous cycle is greater than the pressure in the expansion pocket 6. At lower speeds, therefore, the pressure of the protrusion 27 or of the compression pocket 5 in the spring-side space 49 is greater than the pressure of the expansion pocket 6 in the cap-side space 54, so that the pressure in the space 49 and the force of the spring 51 press the secondary diaphragm 52 against the stop 55. Without the secondary control pressure line, the butterfly valve 14 would—at high idling speeds—be opened to a greater or lesser extent by the increasing supercharge pressure and the decreasing pressure in the protrusion or in the compression pocket. The pressure in the expansion pocket 6 acts against this because this pressure increases with increasing speed and finally exceeds the opposing pressure composed of the pressure in the space 49 and the pressure of the spring 51, thus compressing the spring 51 and keeping the supercharge air butterfly valve 14 closed. In this way, the shape of the curve c shown in FIG. 1 is obtained in the region of higher idling speeds. Using the simple diaphragm capsule shown in FIGS. 2 to 6, the shape of the curve c and hence the operating range D with closed supercharge air butterfly valve would be less favourable. Relative to the simpler arrangements, therefore, the double diaphragm capsule improves the effect intended by the invention in the range of higher idling speeds.

Figure 8:
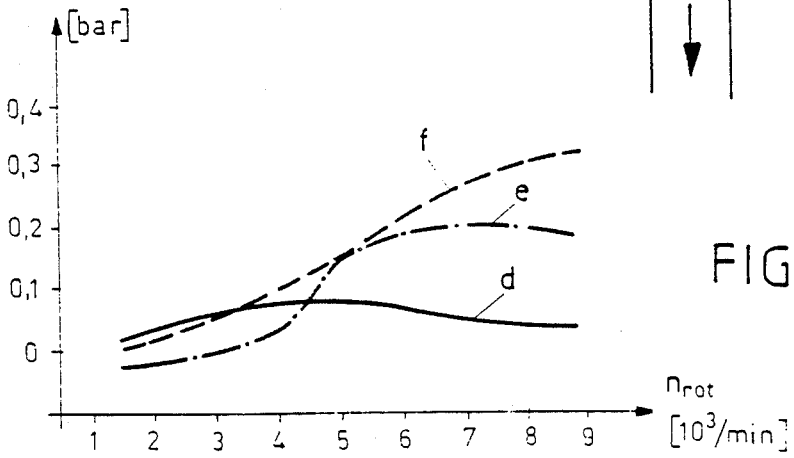
FIG. 8 presents a diagram which shows the typical variation of the pressure differences of the pressure wave process which can be used for the control device.

The diagram of FIG. 8 shows the variation of the pressures, typical of the process, used for controlling the previously described variants as a function of rotor speed, plotted as the gauge pressure (above atmospheric) in each case. The curve d represents the variation of this pressure in the protrusion 27 or in the compression pocket 5, the curve e the variation of the supercharge pressure and the curve f the variation of the pressure in the expansion pocket 6. Because of these pressure variations, the shape of the line c of FIG. 1 can be determined if the spring constants of the spring 51 are known. This closing characteristic can be influenced by both the selection of the spring 51 and by the effective area ratio of the two diaphragms 47 and 52—which also, of course, applies for the arrangements with a simple diaphragm capsule with respect to the selection of the spring and the diaphragm.

Figure 9:
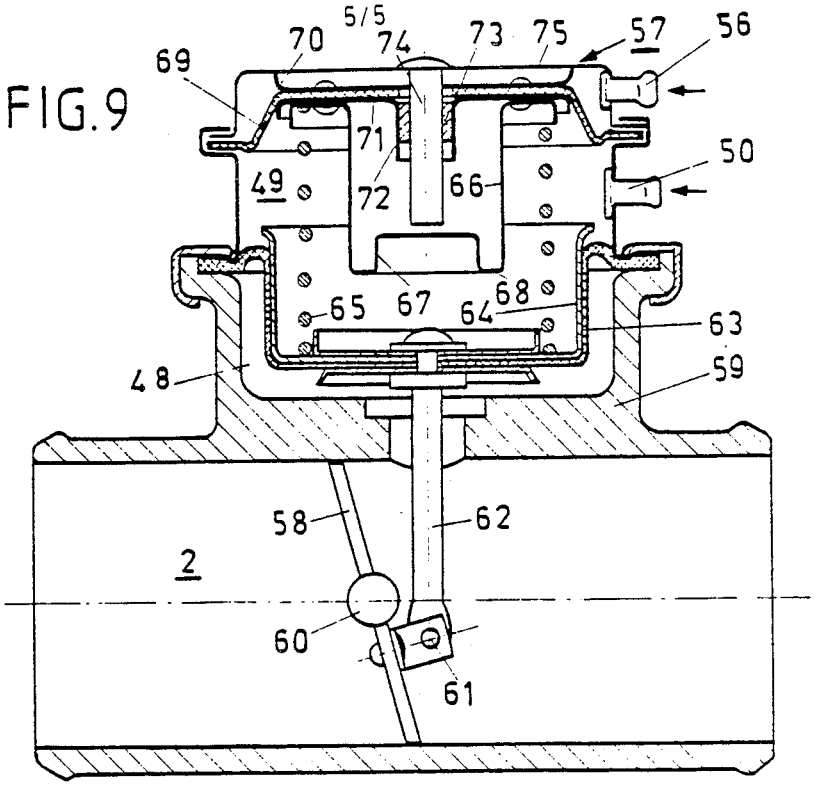
FIG. 9 shows a setting device with supercharge air butterfly valve for the control device of FIG. 7.

FIG. 9 shows a practical design of a double diaphragm capsule 57 and a supercharge air butterfly valve 58, which together form a constructional unit. As in the earlier embodiments, the butterfly valve 58 is supported pivotably with its shaft 60 in a butterfly valve casing 59 and is connected by a pin 61 and a rod 62 to the primary diaphragm 63. The latter is supported on a lower spring plate 64 which serves as the lower support for a spring 65. The upper support of the spring 65 forms the rim of a pot-shaped socket 66 whose bottom has a central cylindrical depression 67. The outer part of the bottom therefore forms an annular stop surface 68 which limits the stroke of the secondary diaphragm 69 in the downward direction and serves as the stop for the opening movement of the butterfly valve 58. The upper stroke limitation element of the secondary diaphragm 69 is formed by an upper support plate 70 and the secondary diaphragm 69 is clamped between this and a lower support plate 71. The lower support plate 71 has a central hub-shaped part 72 with a guide bush 73 which sits so that it can slide on a guide trunnion 74 and, together with the latter, provides central guidance for the secondary diaphragm 69. The pot-shaped socket 66 is also fastened to the lower support plate 71 and therefore to the secondary diaphragm 69. The guide trunnion 74 is fastened to the closing cap 75 of the double diaphragm capsule 57. The primary control pressure line 50 and the secondary control pressure line 56 are connected to the corresponding pressure spaces of the double diaphragm capsule 57 at the connecting nipples, which are provided with the same reference numbers.

Figure 10:
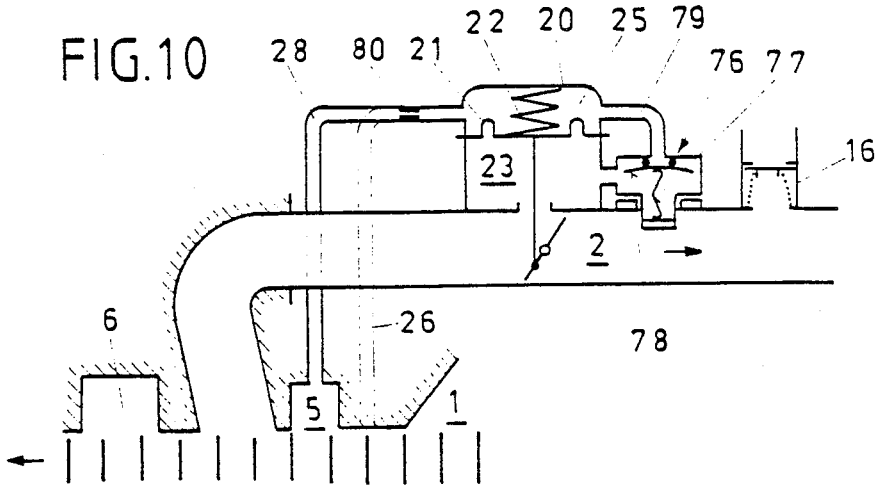
FIG. 10 shows a control device in accordance with FIG. 2 with a temperature valve for limiting the supercharge air temperature.

The requirement for an upper limitation to the supercharge air temperature, mentioned at the beginning, can be satisfied by means of a temperature-controlled bimetal valve 76, as shown in FIG. 10. As soon as the supercharge air temperatures exceeds the permissible maximum value with the supercharge air butterfly valve 14 open, a bimetal strip 77 deforms in such a way that a closing element 78 lifts off its valve seat and short-circuits the spring-side space 25 of the diaphragm capsule 20 to the butterfly valve-side space 23, via an auxiliary connecting line 79. Since approximately the same pressure is then present on both sides of the diaphragm 21, the spring 22 presses the butterfly valve 14 into the closed position. The engine then runs as an induction engine, inducing the combustion air via the breather valve 16, until the supercharge air temperature has again dropped below the permissible maximum value. The bimetal valve then closes the auxiliary connecting line 79 and the engine again operates on supercharge air compressed by the pressure wave supercharger. A throttle 80 is provided in the control air line 28 in order to achieve approximately equal pressures on both sides of the diaphragm 21.

It is, of course, possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations, changes and equivalents which fall within the range of the claims are intended to be embraced therein.

What is claimed is:

1. An internal combustion engine having a pressure wave supercharger as the supercharging device, which pressure wave supercharger has a rotor casing whose two end surfaces are closed off by an air casing and a gas casing and which rotor casing accepts a cell rotor supported in the air casing, the air casing having, per cycle, a low pressure air duct, a high pressure air duct, a compression pocket located before the high pressure air duct, seen in the direction of rotation of the rotor, and an expansion pocket between the high pressure air duct and the low pressure air duct of the following cycle, the gas casing having, per cycle, a high pressure gas duct, a low pressure gas duct and a gas pocket, the latter located between the high pressure gas duct and the low pressure gas duct, and, in addition, a symmetrically supported supercharge air butterfly valve positioned in the high pressure air duct, the air butterfly valve being provided with a control device for the load-dependent control of the position of the supercharge air butterfly valve and a breather valve located between the supercharge air butterfly valve and the engine being present in the high pressure air duct, the control device having a diaphragm capsule with at least one diaphragm, in which one side of this diaphragm forms a part of the boundary of the space communicating with the high pressure air line, wherein the other side of the diaphragm forms a part of the boundary of a space communicating with a control pressure line, wherein this space communicates via this control pressure line with a position in the space between the air casing side face of the cell rotor and the air casing, which position, seen in the rotational direction of the cell rotor, is located before the high pressure air duct, wherein the diaphragm is loaded by a spring in the closing direction of the supercharge air butterfly valve, wherein the high pressure gas duct in the gas casing is so located relative to the entry of the control pressure line into the rotor space and its dimensions in the rotor peripheral direction and the width of the rotor cells and so dimensioned that free flow paths exist between the high pressure gas duct via rotor cells to the control pressure line.

2. The internal combustion engine as claimed in claim 1, wherein the gas casing of the pressure wave supercharger has an upstream pocket located before the high pressure gas duct, seen in the direction of rotation of the cell rotor, which upstream pocket is so located in the rotor space and dimensioned relative to the high pressure gas duct and the entry of the control pressure line that free flow paths exist between the high pressure exhaust gas duct via the upstream pocket and the rotor cells to the control pressure line.

3. The internal combustion engine as claimed in claim 1 wherein the entry of the control pressure line into the rotor space is located in a protrusion between the low pressure air duct and the compression pocket and that the entry communicates with the compression pocket via a transfer duct.

4. The internal combustion engine as claimed in claim 1 wherein the control pressure line enters into the compression pocket.

5. The internal combustion engine as claimed in claim 1, wherein there is a double diaphragm capsule, having a primary diaphragm loaded by a spring in the closing direction of the supercharge air butterfly valve, both sides of which primary diaphragm can be subjected to pressures typical of the pressure wave process via a primary control pressure line, having a secondary diaphragm, one side of which facing towards the primary diaphragm can be subjected to the same pressures typical of the pressure wave process as the primary diaphragm and whose other side, together with a part of the casing of the double diaphragm capsule, forms the boundaries of a space which communicates with the expansion pocket via a secondary control pressure line, the spring being clamped between the primary diaphragm and the seondary diaphragm.

6. The internal combustion engine as claimed in claim 1 wherein the diaphragm capsule space communicating with the control pressure line or the primary control pressure line is connected, via an auxiliary connection line, to the butterfly valve-side space of the diaphragm capsule and wherein a temperature control valve is provided at the entry of this auxiliary connection line into the space, which temperature control valve short-circuits the space mentioned of the diaphragm capsule to the space when the maximum permissible supercharge air temperature is exceeded.

7. The internal combustion engine as claimed in claim 1 wherein elements for changing the prestress of the spring are provided at the diaphragm capsule so that it is possible to set a desired supercharge air pressure variation as a function of the loading condition of the engine.

* * * * *